US008632638B2

(12) United States Patent
Simpson-Green et al.

(10) Patent No.: US 8,632,638 B2
(45) Date of Patent: Jan. 21, 2014

(54) METHOD FOR CLEANING DEPOSITS FROM AN ENGINE FUEL DELIVERY SYSTEM

(75) Inventors: Felicia Simpson-Green, Benicia, CA (US); Damon Vaudrin, Vacaville, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 13/296,354

(22) Filed: Nov. 15, 2011

(65) Prior Publication Data

US 2012/0125445 A1 May 24, 2012

Related U.S. Application Data

(60) Provisional application No. 61/458,199, filed on Nov. 19, 2010.

(51) Int. Cl.
*B08B 9/00* (2006.01)

(52) U.S. Cl.
USPC ..... 134/22.1; 134/20; 134/22.13; 134/22.14; 134/22.17; 134/22.19; 134/26; 134/36; 134/39; 134/40; 134/42

(58) Field of Classification Search
USPC ..... 134/20, 22.1, 22.13, 22.14, 22.17, 134/22.19, 26, 36, 39, 40, 42
See application file for complete search history.

(56) References Cited

U.S. PATENT DOCUMENTS

| | | | | |
|---|---|---|---|---|
| 2,509,197 | A * | 5/1950 | Martin et al. | 510/437 |
| 2,622,018 | A | 12/1952 | White et al. | |
| 2,626,225 | A * | 1/1953 | Brandes et al. | 134/20 |
| 2,904,458 | A * | 9/1959 | Dykstra et al. | 134/20 |
| 2,952,637 | A * | 9/1960 | Bray et al. | 510/186 |
| 2,964,429 | A * | 12/1960 | Bland | 134/28 |
| 3,382,181 | A * | 5/1968 | Oberdorfer, Jr. | 510/187 |
| 3,438,757 | A | 4/1969 | Honnen et al. | |
| 3,565,804 | A | 2/1971 | Honnen et al. | |
| 3,574,576 | A | 4/1971 | Honnen et al. | |
| 3,848,056 | A | 11/1974 | Fonseca | |
| 3,849,083 | A | 11/1974 | Dubeck | |
| 3,960,515 | A | 6/1976 | Honnen | |
| 4,160,648 | A | 7/1979 | Lewis et al. | |
| 4,191,537 | A | 3/1980 | Lewis et al. | |
| 4,197,409 | A | 4/1980 | Lilburn | |
| 4,231,759 | A | 11/1980 | Udelhofen et al. | |

(Continued)

FOREIGN PATENT DOCUMENTS

| | | |
|---|---|---|
| EP | 149486 | 7/1985 |
| EP | 1331377 | 12/2007 |
| GB | 1486144 | 9/1997 |
| WO | 90/10051 | 9/1990 |

OTHER PUBLICATIONS

Ullmann, et al, "Investigation into the Formation and Prevention of Internal Diesel Injector Deposits", SAE International, Paper Series 2008-01-0926.

(Continued)

*Primary Examiner* — Bibi Carrillo

(57) ABSTRACT

Disclosed is a method for cleaning deposits from one or more parts of an engine fuel delivery system, the method comprising introducing into the engine fuel delivery system a cleaning composition comprising (a) one or more aromatic hydrocarbon solvents; and (b) one or more propylene glycol ethers.

18 Claims, 1 Drawing Sheet

(56) References Cited

U.S. PATENT DOCUMENTS

| | | | |
|---|---|---|---|
| 4,233,168 | A | 11/1980 | Lewis et al. |
| 4,236,020 | A | 11/1980 | Lewis et al. |
| 4,243,798 | A | 1/1981 | Franklin et al. |
| 4,270,930 | A | 6/1981 | Campbell et al. |
| 4,288,612 | A | 9/1981 | Lewis et al. |
| 4,292,046 | A | 9/1981 | Piotrowski |
| 4,409,000 | A | 10/1983 | LeSuer |
| 4,518,782 | A | 5/1985 | Sung et al. |
| 4,729,769 | A | 3/1988 | Schlicht et al. |
| 4,810,263 | A | 3/1989 | Zimmerman et al. |
| 4,832,702 | A | 5/1989 | Kummer et al. |
| 4,836,829 | A | 6/1989 | Zimmerman et al. |
| 4,881,945 | A | 11/1989 | Buckley, III |
| 5,112,364 | A | 5/1992 | Rath et al. |
| 5,139,534 | A | 8/1992 | Tomassen et al. |
| 5,287,834 | A | 2/1994 | Flynn |
| 5,393,309 | A | 2/1995 | Cherpeck |
| 5,588,973 | A | 12/1996 | Blackborowet |
| 5,618,320 | A | 4/1997 | Cherpeck |
| 5,620,486 | A | 4/1997 | Cherpeck |
| 5,669,939 | A | 9/1997 | Cherpeck |
| 5,697,988 | A | 12/1997 | Malfer et al. |
| 5,749,929 | A | 5/1998 | Cherpeck et al. |
| 5,752,989 | A | 5/1998 | Henly et al. |
| 5,833,765 | A | 11/1998 | Flynn et al. |
| 5,851,242 | A | 12/1998 | Cherpeck et al. |
| 5,916,825 | A | 6/1999 | Cherpeck |
| 5,954,843 | A | 9/1999 | Cherpeck |
| 5,955,410 | A | 9/1999 | Dingess et al. |
| 5,993,497 | A | 11/1999 | Cherpeck |
| 6,114,542 | A | 9/2000 | Cherpeck |
| 6,203,584 | B1 | 3/2001 | Fuentes-Afflick et al. |
| 6,217,624 | B1 | 4/2001 | Morris et al. |
| 6,616,776 | B1 * | 9/2003 | Ahmadi et al. ..... 134/40 |
| 6,652,667 | B2 | 11/2003 | Ahmadi et al. |
| 2002/0107161 | A1 | 8/2002 | Gatzke et al. |
| 2003/0158060 | A1 | 8/2003 | Ahmadi et al. |
| 2003/0158061 | A1 | 8/2003 | Ahmadi et al. |
| 2005/0268540 | A1 | 12/2005 | Ahmadi et al. |
| 2006/0142172 | A1 | 6/2006 | Cioletti et al. |
| 2009/0101171 | A1 | 4/2009 | Warren et al. |
| 2010/0139697 | A1 | 6/2010 | Martens et al. |

OTHER PUBLICATIONS

Ullmann et al. "Effects of Fuel Impurities and Additive Interactions on the Formation of Internal Diesel Injector Deposits" Fuels Technische Akademie Esslinger, 2009.

Schwab, et al. "Internal Injector Deposits in High-Pressure Common Rail Diesel Engines" SAE International, Paper Series 2010-01-2242, published Oct. 25, 2010.

Caprotti et al. "Deposit Control in Modern Desel Fuel Injection Systems" SAE International,Paper Series 2010-01-2250, published Oct. 25, 2010.

Barker et al. "Insights into Deposit Formation in High Pressure Diesel Fuel Injection Equipment". Paper Series 2010-10-2243, published Oct. 25, 2010.

PCT International Search Report, PCT/US2011/060701, filed Nov. 15, 2011, Mail Date: Jun. 26, 2012.

* cited by examiner

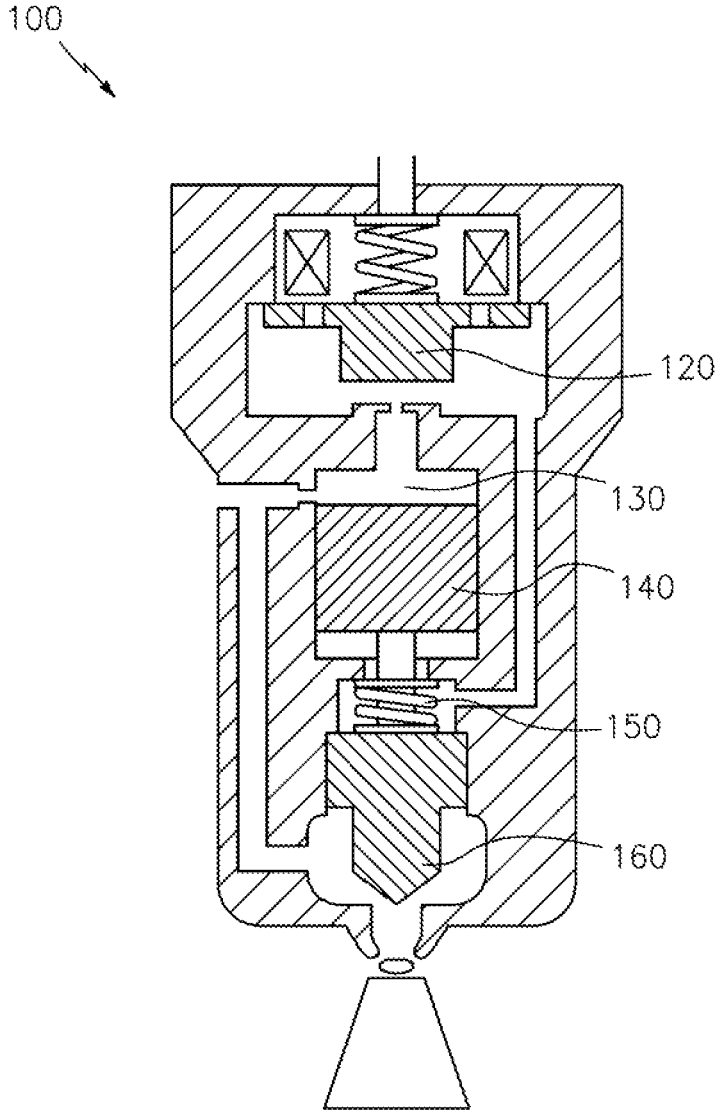
100
120
130
140
150
160

METHOD FOR CLEANING DEPOSITS FROM AN ENGINE FUEL DELIVERY SYSTEM

PRIORITY

This application claims the benefit under 35 U.S.C. §119 to U.S. Provisional Patent Application No. 61/458,199, filed on Nov. 19, 2010, the contents of which are incorporated by reference herein.

BACKGROUND OF THE INVENTION

1. Technical Field

The present invention generally relates to a method for cleaning deposits from an engine fuel delivery system such as a fuel injector.

2. Description of the Related Art

It is well known that automobile engines tend to form deposits on the surface of engine components, such as carburetor ports, throttle bodies, fuel injectors, intake ports, intake valves, and combustion chambers, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art. However, even after employing fuel detergents, injectors and other components subject to heavy deposits and/or tenacious deposit regimes require occasional additional cleaning to maintain optimum performance.

Engines operating on diesel fuel rely on injection of diesel fuel into the combustion chamber of the engine rather than on aspiration of the fuel into the air intake system of the engine such as is the case with most gasoline engines. Diesel fuel injectors atomize the diesel fuel into very small droplets by forcing the fuel through a small injector hole or orifice under high pressure. In recent years, droplet size has been decreased by atomizing the fuel at higher pressures through smaller orifices, which are supplied through other injector parts of similarly smaller size such as pintles, armatures, plungers and needles, injector cups, and injection chambers. In addition many injectors are operating at higher temperatures than was previously the case. This is due not only to the increase in pressure, but also to changes in injector component designs, along with increased use of turbocharging, High Pressure Common Rail fuel systems (HPCR), fuel injection strategies, exhaust emissions and other efforts to control NVH (Noise, Vibration, and Harshness).

There have also been changes in recent years to the diesel fuel itself. The drastic reduction in the sulfur content of diesel fuel has made the fuel more oxidatively unstable, and in some cases requires higher amounts of fuel lubricity additives. Some states are also mandating the use of biodiesel which further complicates the problem.

These increased pressures and temperatures, and changes in the fuel, have resulted in increased amounts and increased sensitivity to deposits that form in the fuel injector and other fuel system components. These deposits stick or disable proper function of internal fuel system function, thus effecting the proper operation of the engines fuel system. Example of components that affected can include, but are not limited to, pintles, armatures, plungers and needles, injector cup, injection chamber intensifier piston, timing and fuel control circuits or valves. It has been found that the problems often are not evidenced until the injectors or fuel system components have been in use in the field for some time. Attempts to clean the sticking, stuck or clogged injectors using methods taught in the prior art have to date not been totally successful. Such attempts to fix this problem have been documented in, e.g., SAE papers-2008-01-0926, 2010-01-2242, 2010-01-2243, and 2010-01-2250.

It is also believed that the nature of the deposits has changed. SAE 2008-01-0926, "Investigation into the Formation and Prevention of Internal diesel Fuel Injector Deposits, and Fuels Technische Akademie Esslingen Colloquium 2009, "Effects of Fuel Impurities and Additive Interactions on the Formation of Internal Diesel Injector Deposits", disclose that deposits in modern diesel fuel injector systems are of two different types: "polymeric" deposits derived from additives, especially polymeric succinimides, contained in the fuel; and sodium compounds.

U.S. Pat. No. 6,616,776 ("the '776 patent") discloses a method for removing engine deposits in a reciprocating internal combustion engine by introducing a cleaning composition into an air-intake manifold of a warmed-up and idling reciprocating internal combustion engine and running the engine while the cleaning composition is being introduced. The '776 patent further discloses that the cleaning solution for use in the method contains a first solution containing a mixture of (a) a phenoxy mono- or poly(oxyalkylene) alcohol; (b) at least one solvent selected from (1) an alkoxy mono- or poly(oxyalkylene) alcohol and (2) an aliphatic or aromatic organic solvent; and (c) at least one nitrogen-containing detergent additive; and a second solution containing a mixture of: (d) a phenoxy mono- or poly(oxyalkylene) alcohol; (e) a cyclic carbonate; and (e) water.

U.S. Pat. No. 6,652,667 ("the '667 patent") discloses a method for removing engine deposits in a gasoline internal combustion engine by introducing a cleaning composition into an air-intake manifold of a warmed-up and idling gasoline internal combustion engine and running the engine while the cleaning composition is being introduced. The '667 patent further discloses that the cleaning solution for use in the method contains (a) a phenoxy mono- or poly(oxyalkylene) alcohol; (b) at least one solvent selected from (1) an alkoxy mono- or poly(oxyalkylene) alcohol and (2) an aliphatic or aromatic organic solvent; and (c) at least one nitrogen-containing detergent additive.

U.S. Patent Application Publication No. 20050268540 ("the '540 application") discloses a fuel composition for the control and/or removal of persistent engine deposits. The fuel composition disclosed in the '540 application contains a major amount of hydrocarbons boiling in the gasoline range fuel, a hydrocarbyl-substituted polyoxyalkylene amine and a glycol ether component.

U.S. Patent Application Publication No. 20100139697 ("the '697 application") discloses a method for removing deposits from at least one compressor powered by an engine. The '697 application further discloses that the method involves (a) disconnecting, while the engine is turned off, a high pressure downstream side of said compressor from an intercooler, or an air intake manifold for non-intercooled engines, while leaving the compressor attached to a means used in the engine to drive the compressor, (b) diverting the output airflow from the compressor away from the engine to a disposal or to a means of separating a cleaning-fluid from air, (c) starting the engine, (d) introducing a means to inject said cleaning fluid into an air stream in the low pressure side upstream of the compressor; and (e) while the engine is running, injecting the cleaning fluid via the means in step (d) for a sufficient time to clean the compressor. The cleaning solution disclosed in the '697 application contains a major amount of an aromatic hydrocarbon solvent and at least one nitrogen containing detergent additive.

Accordingly, it would be desirable to develop methods for cleaning deposits from an engine fuel delivery system such as a fuel injector.

SUMMARY OF THE INVENTION

In accordance with one embodiment of the present invention, there is provided a method for cleaning deposits from one or more parts of an engine fuel delivery system, the method comprising introducing into the engine fuel delivery system a cleaning composition comprising (a) one or more aromatic hydrocarbon solvents; and (b) one or more propylene glycol ethers.

In accordance with a second embodiment of the present invention, there is provided a method for cleaning deposits from one or more parts of an engine fuel delivery system, the method comprising introducing into the engine fuel delivery system a cleaning composition comprising (a) one or more aromatic hydrocarbon solvents; and (b) one or more propylene glycol ethers represented by Formula I:

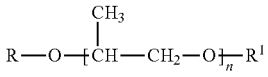

(I)

wherein R is hydrogen or a substituted or unsubstituted $C_1$ to $C_{30}$ hydrocarbyl group, $R^1$ a substituted or unsubstituted $C_1$ to $C_{30}$ hydrocarbyl group and n is an integer from 1 to 4.

In accordance with a third embodiment of the present invention, there is provided the use of a cleaning composition comprising (a) one or more aromatic hydrocarbon solvents; and (b) one or more propylene glycol ethers in cleaning deposits from one or more parts of an engine fuel delivery system.

Among other factors, the present invention is based on the discovery that deposits can be effectively removed from one or more parts of an engine fuel delivery system such as a fuel injector which operates at relatively high pressure, e.g., about 30,000 pounds per square inch, present, for example, in a direct injection internal combustion engine by employing the cleaning composition described herein. In addition, the method of the present invention is believed to clean diesel injector systems more rapidly, and also result in the cleaned injectors remaining cleaner for a relatively long period of time.

BRIEF DESCRIPTION OF THE DRAWING

FIG. 1 is a cross sectional view of a fuel injector.

DETAILED DESCRIPTION OF THE PREFERRED EMBODIMENTS

The present invention is directed to a method for cleaning deposits from one or more parts of an engine fuel delivery system, the method comprising introducing into the engine fuel delivery system a cleaning composition comprising (a) one or more aromatic hydrocarbon solvents; and (b) one or more propylene glycol ethers.

The Aromatic Hydrocarbon Solvent

As used herein, the term "aromatic hydrocarbon solvent" shall be understood to mean any aromatic ring containing solvent or mixture thereof. For reasons of solubility of deposits, compatibility with engine parts and engine fuels, safety, and cost, aromatic hydrocarbon solvents are useful solvents for this invention. Suitable aromatic hydrocarbon solvents include, but are not limited to, benzene, ethylbenzene, toluene, anisol, mesitylene, xylene, o-xylene, m-xylene, and p-xylene and the like and mixtures thereof. In one embodiment the aromatic hydrocarbon solvent is mesitylene. In one embodiment, aromatic petroleum distillates may also be used. Suitable aromatic petroleum distillates include AROMATIC 100, AROMATIC 150, and AROMATIC 200 available from ExxonMobil and Aromatic 150 type Caromax 20ND available from Petrochem Carless.

In general, the concentration of the aromatic hydrocarbon solvent in the cleaning composition will ordinarily range from about 10 to about 40 wt. %, based on the total weight of the cleaning composition. In another embodiment, the concentration of the aromatic hydrocarbon solvent in the cleaning composition will range from about 15 to about 30 wt. %, based on the total weight of the cleaning composition. In another embodiment, the concentration of the aromatic hydrocarbon solvent in the cleaning composition will range from about 18 wt. % to about 25 wt. %, based on the total weight of the cleaning composition.

The Propylene Glycol Ethers

The cleaning composition for use in the method of the present invention will also contain one or more propylene glycol ethers. One class of propylene glycol ether for use in the cleaning composition is represented by Formula I:

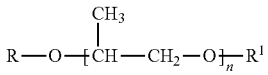

(I)

wherein R is hydrogen or a substituted or unsubstituted $C_1$ to $C_{30}$ hydrocarbyl group, $R^1$ a substituted or unsubstituted $C_1$ to $C_{30}$ hydrocarbyl group and n is an integer from 1 to 3. In one embodiment, R is hydrogen and $R^1$ is a substituted or unsubstituted $C_1$ to $C_6$ hydrocarbyl group. In another embodiment, R and $R^1$ are the same or different and can be a substituted or unsubstituted $C_1$ to $C_6$ hydrocarbyl group. In one embodiment n is 2.

Representative examples of suitable substituted or unsubstituted $C_1$ to $C_{30}$ hydrocarbyl group include, but are not limited to, a substituted or unsubstituted $C_1$ to about $C_{30}$ alkyl group, a substituted or unsubstituted $C_1$ to about $C_{30}$ alkenyl group, a substituted or unsubstituted $C_3$ to about $C_{30}$ cycloalkyl group, a substituted or unsubstituted $C_3$ to about $C_{30}$ cycloalkenyl group, a substituted or unsubstituted $C_5$ to about $C_{30}$ cycloalkylalkyl group, a substituted or unsubstituted $C_5$ to about $C_{30}$ aryl, a substituted or unsubstituted $C_5$ to about $C_{30}$ arylalkyl group and the like.

Representative examples of substituted or unsubstituted alkyl groups for use herein include, by way of example, a straight or branched alkyl chain radical containing carbon and hydrogen atoms of from 1 to about 30 carbon atoms and preferably from 1 to about 6 carbon atoms, e.g., methyl, ethyl, n-propyl, isopropyl, n-butyl, n-pentyl, etc., and the like.

Representative examples of substituted or unsubstituted alkenyl groups for use herein include, by way of example, a straight or branched alkyl chain radical containing carbon and hydrogen atoms of from 1 to about 30 carbon atoms and preferably from 2 to about 6 carbon atoms with at least one carbon-carbon double bond, e.g., methylene, ethylene, n-propylene, etc., and the like.

Representative examples of substituted or unsubstituted cycloalkyl groups for use herein include, by way of example, a substituted or unsubstituted non-aromatic mono or multicyclic ring system of 3 to about 30 carbon atoms and preferably 3 to 12 carbon atoms such as, for example, cyclopropyl, cyclobutyl, cyclopentyl, cyclohexyl, bridged cyclic groups or sprirobicyclic groups, e.g., spiro-(4,4)-non-2-yl and the like, optionally containing one or more heteroatoms, e.g., O and N, and the like.

Representative examples of substituted or unsubstituted cycloalkylalkyl groups for use herein include, by way of example, a substituted or unsubstituted cyclic ring-containing radical containing from about 5 to about 30 carbon atoms and preferably 3 to 12 carbon atoms which is directly attached to an alkyl group which is then attached to the oxygen atom of the main structure such as, for example, cyclopropylmethyl, cyclobutylethyl, cyclopentylethyl and the like, wherein the cyclic ring can optionally contain one or more heteroatoms, e.g., O and N, and the like.

Representative examples of substituted or unsubstituted cycloalkenyl groups for use herein include, by way of example, a substituted or unsubstituted cyclic ring-containing radical containing from about 3 to about 30 carbon atoms and preferably 3 to 12 carbon atoms with at least one carbon-carbon double bond such as, for example, cyclopropenyl, cyclobutenyl, cyclopentenyl and the like, wherein the cyclic ring can optionally contain one or more heteroatoms, e.g., O and N, and the like.

Representative examples of substituted or unsubstituted aryl groups for use herein include, by way of example, a substituted or unsubstituted monoaromatic or polyaromatic radical containing from about 5 to about 30 carbon atoms and preferably 6 to 12 carbon atoms such as, for example, phenyl, naphthyl, tetrahydronapthyl, indenyl, biphenyl and the like, optionally containing one or more heteroatoms, e.g., O and N, and the like.

Representative examples of substituted or unsubstituted arylalkyl groups for use herein include, by way of example, a substituted or unsubstituted aryl group as defined herein directly bonded to an alkyl group as defined herein, e.g., $—CH_2C_6H_5$, $—C_2H_5C_6H_5$ and the like, wherein the aryl group can optionally contain one or more heteroatoms, e.g., O and N, and the like.

The substituents in the 'substituted alkyl', 'substituted cycloalkyl', 'substituted cycloalkylalkyl', 'substituted cycloalkenyl', 'substituted aryl', and 'substituted arylalkyl' may be the same or different and include one or more substituents such as hydrogen, hydroxy, halogen, carboxyl, cyano, nitro, oxo (=O), thio(=S), substituted or unsubstituted alkyl, substituted or unsubstituted alkoxy, substituted or unsubstituted alkenyl, substituted or unsubstituted alkynyl, substituted or unsubstituted aryl, substituted or unsubstituted arylalkyl, substituted or unsubstituted cycloalkyl, substituted or unsubstituted cycloalkenyl, substituted or unsubstituted amino, substituted or unsubstituted aryl, substituted or unsubstituted heteroaryl, substituted heterocycloalkyl ring, substituted or unsubstituted heteroarylalkyl, substituted or unsubstituted heterocyclic ring, substituted or unsubstituted guanidine, $—COOR_x$, $—C(O)R_x$, $—C(S)R_x$, $—C(O)NR_xR_y$, $—C(O)ONR_xR_y$, $—NR_xCONR_yR_z$, $—N(R_x)SOR_y$, $—N(R_x)SO_2R_y$, $—(=N—N(R_x)R_y)$, $—NR_xC(O)OR_y$, $—NR_xR_y$, $—NR_xC(O)R_y—$, $—NR_xC(S)R_y—NR_x(S)NR_yR_z$, $—SONR_xR_y—$, $—SO_2NR_xR_y—$, $—OR_x$, $—OR_xC(O)NR_yR_z$, $—OR_xC(O)OR_y—$, $—OC(O)R_x$, $—OC(O)NR_xR_y$, $—R_xNR_yC(O)R_z$, $—R_xOR_y$, $—R_x(O)OR_y$, $—R_xC(O)NR_yR_z$, $—R_xC(O)R_x$, $—R_xOC(O)R_y$, $—SR_x$, $—SOR_x$, $—SO_2R_x$, $—ONO_2$, wherein $R_x$, $R_y$ and $R_z$ in each of the above groups can be the same or different and can be a hydrogen atom, substituted or unsubstituted alkyl, substituted or unsubstituted alkoxy, substituted or unsubstituted alkenyl, substituted or unsubstituted alkynyl, substituted or unsubstituted aryl, substituted or unsubstituted arylalkyl, substituted or unsubstituted cycloalkyl, substituted or unsubstituted cycloalkenyl, substituted or unsubstituted amino, substituted or unsubstituted aryl, substituted or unsubstituted heteroaryl, 'substituted heterocycloalkyl ring' substituted or unsubstituted heteroarylalkyl, or a substituted or unsubstituted heterocyclic ring.

Representative examples of suitable propylene glycol ethers for use herein include propylene glycol ethers such as propylene glycol monomethyl ether, propylene glycol monoethyl ether, propylene glycol monopropyl ether, propylene glycol monobutyl ether, and dipropylene glycol ethers such as dipropylene glycol monomethyl ether, dipropylene glycol monoethyl ether, dipropylene glycol monobutyl ether, and the like and mixtures thereof.

The concentration of the one or more propylene glycol ethers in the cleaning composition will ordinarily range from about 20 to about 50 wt. %, based on the total weight of the cleaning composition. In another embodiment, the concentration of the propylene glycol ether in the cleaning composition will range from about 25 to about 40 wt. %, based on the total weight of the cleaning composition. In another embodiment, the concentration of the propylene glycol ether in the cleaning composition will range from about 28 wt. % to about 33 wt. %, based on the total weight of the cleaning composition.

In one embodiment the cleaning composition for use herein can have a flash point of about 40° C. to about 80° C. In one embodiment, the cleaning composition for use herein can have a flash point of at least about 61° C.

The cleaning compositions for use in the method of the present invention may also contain one or more additional solvents as long as the concentration of such solvents is low enough not to change the overall aromatic nature of the cleaning solution. Representative examples of additional solvents include aliphatic hydrocarbon solvents, and the like and mixtures thereof. Suitable aliphatic hydrocarbon solvents include dearomatized solvents, such as Exxsol D40 and D60, available from ExxonMobil, other aliphatic hydrocarbon solvents, such as D15-20 Naphtha, D115-145 Naphtha and D31-35 Naphtha, also available from ExxonMobil, and nonaromatic mineral, spirits, and the like and mixtures thereof.

The concentration of the additional solvents in the cleaning composition can range from about 10 to about 70 wt. %, based on the total weight of the cleaning composition. In another embodiment, the concentration of the additional solvents in the cleaning composition can range from about 35 to about 60 wt. %, based on the total weight of the cleaning composition.

The cleaning compositions for use in the method of the present invention may also contain one or more nitrogen-containing detergents. Suitable nitrogen-containing detergent additives for use in this invention include, for example, aliphatic hydrocarbyl-substituted amines, hydrocarbyl-substituted poly(oxyalkylene) amines, hydrocarbyl-substituted succinimides, Mannich reaction products, nitro and amino aromatic esters of polyalkylphenoxyalkanols, polyalkylphenoxyaminoalkanes, and mixtures thereof.

The aliphatic hydrocarbyl-substituted amines which may be employed in the cleaning compositions are typically straight or branched chain hydrocarbyl-substituted amines having at least one basic nitrogen atom and wherein the hydrocarbyl group has a number average molecular weight of about 700 to 3,000. In one preferred embodiment, an aliphatic hydrocarbyl-substituted amine includes polyisobutenyl and polyisobutyl monoamines and polyamines.

The aliphatic hydrocarbyl-substituted amines are prepared by conventional procedures known in the art. Such aliphatic hydrocarbyl-substituted amines and their preparations are described in detail in, for example, U.S. Pat. Nos. 3,438,757; 3,565,804; 3,574,576; 3,848,056; 3,960,515; 4,832,702; and 6,203,584, the disclosures of which are incorporated herein by reference.

Another class of nitrogen-containing detergent additives suitable for use in the cleaning compositions is the hydrocarbyl-substituted poly(oxyalkylene) amines, also referred to as polyether amines. Typical hydrocarbyl-substituted poly(oxyalkylene) amines include hydrocarbyl poly(oxyalkylene) monoamines and polyamines wherein the hydrocarbyl group contains from 1 to about 30 carbon atoms, the number of oxyalkylene units can range from about 5 to 100, and the amine moiety is derived from ammonia, a primary alkyl or secondary dialkyl monoamine, or a polyamine having a terminal amino nitrogen atom. In one embodiment, the oxyalkylene moiety will be oxypropylene or oxybutylene or a mixture thereof. Such hydrocarbyl-substituted poly(oxyalkylene) amines are described, for example, in U.S. Pat. Nos. 5,112,364 and 6,217,624, the disclosures of which are incorporated herein by reference.

In one preferred embodiment, a hydrocarbyl-substituted poly(oxyalkylene) monoamine is an alkylphenyl poly(oxyalkylene) monoamine wherein the poly(oxyalkylene) moiety contains oxypropylene units or oxybutylene units or mixtures of oxypropylene and oxybutylene units. The alkyl group on the alkylphenyl moiety is a straight or branched-chain alkyl of 1 to 24 carbon atoms. In one preferred embodiment, the alkylphenyl moiety is tetrapropenylphenyl, that is, where the alkyl group is a branched-chain alkyl of 12 carbon atoms derived from propylene tetramer.

Another example of a hydrocarbyl-substituted poly(oxyalkylene) amine composition is a hydrocarbyl-substituted poly(oxyalkylene) aminocarbamate. Examples of such aminocarbamate include those disclosed in, for example, U.S. Pat. Nos. 4,288,612; 4,160,648; 4,191,537; 4,197,409; 4,233,168; 4,236,020; 4,243,798; 4,270,930; and 4,881,945, the contents of each of which are incorporated herein by reference. The hydrocarbyl poly(oxyalkylene) aminocarbamates contain at least one basic nitrogen atom and have an average molecular weight of about 500 to about 10,000. In another embodiment, the hydrocarbyl poly(oxyalkylene) aminocarbamates contain at least one basic nitrogen atom and have an average molecular weight of about 500 to about 5,000. In another embodiment, the hydrocarbyl poly(oxyalkylene) aminocarbamates contain at least one basic nitrogen atom and have an average molecular weight of about 1,000 to about 3,000. In one preferred embodiment, an aminocarbamate is alkylphenyl poly(oxybutylene) aminocarbamate wherein the amine moiety is derived from ethylene diamine or diethylene triamine.

Another class of nitrogen-containing detergent additives suitable for use in the cleaning compositions is the hydrocarbyl-substituted succinimides. The hydrocarbyl-substituted succinimides include polyalkyl and polyalkenyl succinimides wherein the polyalkyl or polyalkenyl group has an average molecular weight of about 500 to 5,000. In another embodiment, the hydrocarbyl-substituted succinimides include polyalkyl and polyalkenyl succinimides wherein the polyalkyl or polyalkenyl group has an average molecular weight of about 700 to about 3,000. The hydrocarbyl-substituted succinimides are typically prepared by reacting a hydrocarbyl-substituted succinic anhydride with an amine or polyamine having at least one reactive hydrogen bonded to an amine nitrogen atom. In one preferred embodiment, a hydrocarbyl-substituted succinimides include polyisobutenyl and polyisobutanyl succinimides, and derivatives thereof.

The hydrocarbyl-substituted succinimides for use herein are described, for example, in U.S. Pat. Nos. 5,393,309; 5,588,973; 5,620,486; 5,916,825; 5,954,843; 5,993,497; and 6,114,542, and British Patent No. 1,486,144, the contents of each of which are incorporated herein by reference.

Another class of nitrogen-containing detergent additives suitable for use in the cleaning compositions is a Mannich reaction product which is typically obtained from the Mannich condensation of a high molecular weight alkyl-substituted hydroxyaromatic compound, an amine containing at least one reactive hydrogen, and an aldehyde. The high molecular weight alkyl-substituted hydroxyaromatic compounds are usually polyalkylphenols, such as polypropylphenol and polybutylphenol, especially polyisobutylphenol, wherein the polyakyl group has an average molecular weight of about 600 to about 3,000. The amine reactant is typically a polyamine, such as alkylene polyamines, especially ethylene or polyethylene polyamines, for example, ethylene diamine, diethylene triamine, triethylene tetramine, and the like. The aldehyde reactant is generally an aliphatic aldehyde, such as formaldehyde, including paraformaldehyde and formalin, and acetaldehyde. In one preferred embodiment, a Mannich reaction product is obtained by condensing a polyisobutylphenol with formaldehyde and diethylene triamine, wherein the polyisobutyl group has an average molecular weight of about 1,000.

The Mannich reaction products for use herein are described, for example, in U.S. Pat. Nos. 4,231,759 and 5,697,988, the contents of each of which are incorporated herein by reference.

Another class of nitrogen-containing detergent additives suitable for use in the cleaning compositions is a polyalkylphenoxyaminoalkane. A representative example of a polyalkylphenoxyaminoalkane includes those having the Formula II:

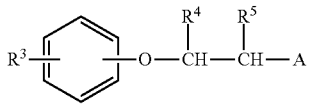

(II)

wherein $R^3$ is a polyalkyl group having an average molecular weight in the range of about 600 to about 5,000; $R^4$ and $R^5$ are independently hydrogen or lower alkyl having 1 to 6 carbon atoms; and A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms.

The polyalkylphenoxyaminoalkanes of Formula II and their preparations are described in detail in, for example, U.S. Pat. No. 5,669,939, the contents of which are incorporated herein by reference.

Mixtures of polyalkylphenoxyaminoalkanes and poly(oxyalkylene) amines are also suitable for use in the cleaning compositions. These mixtures are described in detail in, for example, U.S. Pat. No. 5,851,242, the contents of which are incorporated herein by reference.

Another class of nitrogen-containing detergent additives includes nitro and amino aromatic esters of polyalkylphenoxyalkanols. A representative example of a nitro and amino aromatic ester of a polyalkylphenoxyalkanol include those of Formula III (III)

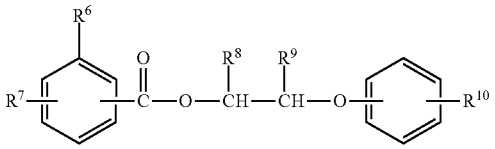

wherein: $R^6$ is nitro or —$(CH^2)_n$—$NR^{11}R^{12}$, wherein $R^{11}$ and $R^{12}$ are independently hydrogen or lower alkyl having 1 to 6 carbon atoms and n is 0 or 1; $R^7$ is hydrogen, hydroxy, nitro or —$NR^{13}R^{14}$, wherein $R^{13}$ and $R^{14}$ are independently hydrogen or lower alkyl having 1 to 6 carbon atoms; $R^8$ and $R^9$, are independently hydrogen or lower alkyl having 1 to 6 carbon atoms; and $R^{10}$ is a polyalkyl group having an average molecular weight in the range of about 450 to about 5,000.

The aromatic esters of polyalkylphenoxyalkanols shown in Formula III above and their preparations are described in, for example, U.S. Pat. No. 5,618,320, the contents of which are incorporated herein by reference.

Mixtures of nitro and amino aromatic esters of polyalkylphenoxyalkanols and hydrocarbyl-substituted poly(oxyalkylene) amines are also preferably contemplated. These mixtures are described in, for example, U.S. Pat. No. 5,749,929, the contents of which are incorporated herein by reference.

One class of hydrocarbyl-substituted poly(oxyalkylene) amines which may be employed as nitrogen-containing detergent additives include those having the Formula IV:

(IV)

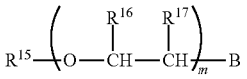

wherein $R^{15}$ is a hydrocarbyl group having from about 1 to about 30 carbon atoms; $R^{16}$ and $R^{17}$ are each independently hydrogen or lower alkyl having about 1 to about 6 carbon atoms and each $R^{16}$ and $R^{17}$ is independently selected in each —O—$CHR^{16}$—$CHR^{17}$— unit; A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and m is an integer from about 5 to about 100.

The hydrocarbyl-substituted poly(oxyalkylene) amines of Formula IV above and their preparations are described in, for example, U.S. Pat. No. 6,217,624, the contents of which are incorporated herein by reference.

Another class of nitrogen-containing detergent additives includes nitrogen-containing carburetor/injector detergents. The carburetor/injector detergent additives are typically relatively low molecular weight compounds having a number average molecular weight of about 100 to about 600 and possessing at least one polar moiety and at least one non-polar moiety. The non-polar moiety is typically a linear or branched-chain alkyl or alkenyl group having about 6 to about 40 carbon atoms. The polar moiety is typically nitrogen-containing. Typical nitrogen-containing polar moieties include amines (e.g., as described in U.S. Pat. No. 5,139,534 and PCT International Publication No. WO 90/10051), ether amines (e.g., as described in U.S. Pat. No. 3,849,083 and PCT International Publication No. WO 90/10051), amides, polyamides and amide-esters (e.g., as described in U.S. Pat. Nos. 2,622,018; 4,729,769; and 5,139,534; and European Pat. Publication No. 149,486), imidazolines (e.g., as described in U.S. Pat. No. 4,518,782), amine oxides (e.g., as described in U.S. Pat. Nos. 4,810,263 and 4,836,829), hydroxyamines (e.g., as described in U.S. Pat. No. 4,409,000), and succinimides (e.g., as described in U.S. Pat. No. 4,292,046).

The concentration of the nitrogen-containing detergent additives in the cleaning composition can range from about 1 to about 10 wt. %, based on the total weight of the cleaning composition. In another embodiment, the concentration of the nitrogen-containing detergent additives in the cleaning composition can range from about 2 to about 5 wt. %, based on the total weight of the cleaning composition.

The method of the present invention can clean deposits throughout one or more parts of an engine fuel delivery system or the entire fuel delivery system. In one embodiment, the engine is a diesel, i.e. compression ignition, engine. In one embodiment, the engine is a direct injection diesel engine. In one embodiment, the engine is an indirect injection diesel engine. In one embodiment, the engine fuel delivery system contains one or more fuel pumps and/or one or more fuel injectors. An example of a fuel injector for use in the cleaning method of the present invention is generally depicted in FIG. 1. As shown in FIG. 1, fuel injector 100 typically includes an armature 120, a control chamber 130, a control piston 140, spring 150 and needle 160.

In one embodiment, the engine fuel delivery systems to be cleaned herein operate under relatively high pressures. For indirect injection engines, the pressure may be at least about 2,000 pounds per square inch (psi). In one embodiment the pressure of an engine fuel delivery system in an indirect injection engine is no greater than about 3500 psi. In one embodiment the pressure of an engine fuel delivery system in an indirect injection engine is from about 2,000 psi to no greater than about 3500 psi. For direct injection engines, the pressure may be at least about 10,000 psi. In one embodiment, the pressure of an engine fuel delivery system in a direct injection engine is no greater than about 50,000 psi. In one embodiment, the pressure of an engine fuel delivery system in a direct injection engine is from about 10,000 psi to no greater than about 50,000 psi. In another embodiment, the pressure of an engine fuel delivery system in used in a direct injection engine is from about 25,000 psi to no greater than about 50,000 psi.

In one embodiment the engine fuel delivery systems to be cleaned herein operate under relatively high temperatures. For indirect injection engines, the temperature may be at least about 70° C. In one embodiment, the temperature may be at least about 100° C. In one embodiment, the temperature may be at least about 120° C. In one embodiment, the temperature may be at least about 70° C. and no greater than about 120° C. For direct injection engines, the temperature may be at least about 70° C. In one embodiment, the temperature may be at least about 100° C. In one embodiment, the temperature may be at least about 150° C. In one embodiment, the temperature may be at least about 70° C. and no greater than about 150° C.

Typically the cleaning composition is introduced into the fuel delivery system for a period of time sufficient to clean the fuel delivery system to the desired level of cleanliness. The desired level of cleanliness can be determined by one skilled in the art by, for example, improvement in engine operating parameters such as reduction in black smoke, elimination of engine misfire, and ease of starting.

In general, the cleaning composition is introduced into the engine fuel delivery system by any method and apparatus known in the art. In one embodiment the method is employed while the engine is running, and the cleaning composition is a full or partial replacement for the normal operating fuel of the engine. Accordingly, the method can be carried out in a fully warmed-up engine and while the engine is running at speeds ranging from manufacturer recommended idle speed to about 3000 rotations per minute (RPM).

Various application tools can be used for the introduction of the cleaning composition into the engine fuel delivery system. Such application tools may include the cleaning apparati described in U.S. Pat. Nos. 5,287,834 and 5,833,765, the contents of which are incorporated herein by reference. In one embodiment, the application tool can be a cleaning liquid storage container that is used to replace the fuel tank of the vehicle or engine as a source of fuel for the engine during the cleaning process and to contain the cleaning composition. In this embodiment, the fuel tank is disconnected and replaced by the container which is configured such that various adaptors to fit the engine model can be used to deliver the cleaning composition to the engine fuel delivery system and return it to the container. Once the cleaning process is completed, the container is disconnected and replaced with the fuel tank. In one embodiment, the application tool for delivering the cleaning composition includes a graduated bottle or container, either under atmospheric pressure or pressurized. In the case of where the bottle or container is operated under pressure, the application tool is equipped with a pressure gauge for checking the pressure of the introduced composition and a pressure control valve for controlling the pressure. The bottle or container can have specific adapters that connect to the specific fuel system supply and return fuel lines or fuel system components. In addition, bottle or container will also have a valve for opening and closing the line for introducing the cleaning composition into the engine fuel delivery system.

The following non-limiting examples are illustrative of the present invention.

EXAMPLES

The efficacy of the formulations of the invention has been demonstrated by means of tests performed on certain test deposits. These deposits are believed to be representative of deposits formed under the high temperature, high pressure conditions found in modern fuel injector systems. The deposits are a mixture of "polymeric" deposits and sodium compounds as described in Effects of Fuel Impurities and Additive Interactions on the Formation of Internal Diesel Injector Deposits.

The polymeric deposits were created by mixing 21.3 grams of polybutene succinimide additive concentrate with 6 grams of dodecenyl succinic acid, and subsequently heating the mixture at 180° C. for 20 hours.

The sodium compounds were created by mixing dodecyl succinic acid with sodium hydroxide solution on a molar equivalent basis, then drying. Both deposits were verified via Fourier transform infrared spectroscopy (FTIR) analyses.

Testing

To test the efficacy of different compounds in cleaning up these different types of deposits, approximately 0.5 grams of each deposit was placed into a beaker and mixed with 20-30 ml of each of the following components, and mixed with spatula and swirled for up to 5 minutes. After mixing and swirling, the mixture in the beaker was evaluated according to the following rating scale:

0=Not effective=Deposit was not visibly changed, cleaning solution did not change color or become cloudy.

1=Sparingly soluble=Slight cloudiness and/or change in color of cleaning solution but no change in deposit appearance.

2=Semisoluble=Solution turned cloudy and/or changed color, and deposit decreased in size

TABLE 1

Oxygenated solvents

| Component | Sodium Compound | Polymeric Deposits |
|---|---|---|
| Benzyl Alcohol | 0 | 0 |
| Ethylene glycol mono butyl ether | 0 | 0 |
| 2-phenoxy ethanol | 0 | 0 |
| di (propylene glycol) methyl ether | 1 | 0 |
| N-Methyl-2-pyrrolidone | 0 | 0 |
| Heptanone | 0 | 0 |
| Propyl benzoate | 0 | 0 |
| Di ethyl ether | 0 | 0 |
| Terpineol | 0 | 0 |
| Methyl ethyl ketone | 0 | 0 |

TABLE 2

Aromatic solvents

| Component | Sodium Compound | Polymeric Deposits |
|---|---|---|
| Mesitylene | 0 | 2 |
| Aromatic 150 | 0 | 1 |
| Aromatic 100 | 0 | 1 |
| d-limonene | 0 | 0 |

TABLE 3

Other solvents

| Component | Sodium Compound | Polymeric Deposits |
|---|---|---|
| Dimethyl sulfoxide | 1 | 0 |
| Dimethyl Formamide | 0 | 0 |

From this data it is clear that an aromatic solvent, in particular mesitylene, is useful in dissolving polymeric deposits, while the propylene glycol-based solvent is effective in dissolving sodium compounds.

The efficacy of finished cleaning fluids containing the components of the invention was also demonstrated by performing the same test on said cleaning fluids. The cleaning fluids were formulated as follows:

Formulation 1

The cleaning solution of Formulation 1 was prepared by mixing 3 wt. % polybutene succinimide concentrate, 41.9 wt. % Exxsol D60 aliphatic solvent, 31 wt. % di (propylene glycol) methyl ether, 24 wt. % mesitylene, and 0.10 wt. % of an aromatic ester.

Formulation 2

The cleaning solution of Formulation 2 was prepared by mixing 3 wt. % polybutene succinimide concentrate, 41.9 wt.

% Exxsol D60 aliphatic solvent, 31 wt. % di (propylene glycol) methyl ether, 14 wt. % mesitylene, 10 wt. % Aromatic 150 solvent, and 0.10 wt. % of an aromatic ester.

Formulation 3

The cleaning solution of Formulation 3 was prepared by mixing 3 wt. % polybutene succinimide concentrate, 41.9 wt. % Exxsol D60 aliphatic solvent, 31 wt. % di (propylene glycol) methyl ether, 24 wt. % Aromatic 150 solvent, and 0.10 wt. % of an aromatic ester.

Comparative Diesel Cleaning Solution 1

The cleaning solution of Comparative Diesel Cleaning Solution 1 was believed to be prepared by mixing approximately 71 wt. % aliphatic solvent, 4 wt. % polybutene succinimide concentrate, and 25 wt. % di (propylene glycol) methyl ether.

Comparative Diesel Cleaning Solution 2

The cleaning solution of Comparative Diesel Cleaning Solution 2 was prepared by mixing 23 wt. % polyetheramine, 16 wt. % benzyl alcohol, 27 wt. % ethylene glycol butyl ether, and 34 wt. % phenoxyethanol.

The efficacy of Formulations 1-3 and Comparative Diesel Cleaning Solutions 1 and 2 in cleaning up the different types of deposits prepared above were tested as described above. It was determined by visual inspection that considerably more deposits were dissolved in Formulations 1-3 than was dissolved in Comparative Diesel Cleaning Solutions 1 and 2.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A method for cleaning fuel injector deposits from one or more parts of an engine fuel delivery system, the method comprising introducing into the engine fuel delivery system a cleaning composition comprising (a) one of more aromatic hydrocarbon solvents; (b) one or more propylene glycol ethers: and (c) one or more nitrogen-containing detergents, to clean the fuel injector deposits from the one or more parts of the engine fuel delivery system, wherein the engine fuel delivery system is present in a compression ignition (diesel) engine, and wherein the one or more propylene glycol ethers are represented by the formula:

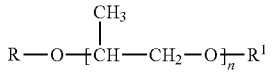

wherein R is hydrogen or a substituted or unsubstituted $C_1$ to $C_{30}$ hydrocarbyl group, $R^1$ is a substituted or unsubstituted $C_1$ to $C_{30}$ hydrocarbyl group and n is an integer from 1 to 4.

2. The method of claim 1, wherein the one or more aromatic, hydrocarbon solvents are selected from the group consisting of benzene, ethylbeuzene, toluene, anisol, mesitylene, xylene, o-xylene, m-xylene. and p-xylene, aromatic petroleum distillate and mixtures thereof.

3. The method of claim 1, wherein the one or more aromatic hydrocarbon solvents in the cleaning composition have a concentration of from about 10 to about 40 wt. %, based on a total weight of the cleaning composition.

4. The method of claim 1, wherein the one or more aromatic hydrocarbon solvents in the cleaning composition have a concentration of from about 15 to about 30 wt. %, based on a total weight of the cleaning, composition.

5. The method of claim 1, wherein the one or more aromatic hydrocarbon solvents in the cleaning composition have a concentration of from about 18 wt. % to about 25 wt. %, based on a total weight of the cleaning composition.

6. The method of Claim 1, wherein R is hydrogen and $R^1$ is a substituted or unsubstituted $C_1$ to $C_6$ hydrocarbyl group.

7. The method of Claim 1, wherein the one or more propylene glycol ethers are selected from the group consisting of propylene glycol monomethyl ether, propylene glycol monoethyl ether, propylene glycol monopropyl ether, propylene glycol monobutyl ether, dipropylene glycol monomethyl ether, dipropylene glycol monoethyl ether, dipropylene glycol monobutyl ether, and mixtures thereof.

8. The method of claim 1, wherein the one or more propylene glycol ethers in the cleaning composition have a concentration of from about 20 to about 50 wt. %, based on a total weight of the cleaning composition.

9. The method of claim 1, wherein the one or more propylene glycol ethers in the cleaning composition have a concentration of from about 25 to about 40 wt. %, based on a total weight of the cleaning, composition.

10. The method of claim 1, wherein the one or more propylene glycol ethers in the cleaning composition have a concentration of from about 28 wt. % to about 33 wt. %, based on a total weight of the cleaning composition.

11. The method of claim 1, wherein the cleaning composition further comprises one or more aliphatic hydrocarbon solvents.

12. The method of Claim 1, wherein the one or more nitrogen-containing detergents are selected from the group consisting of aliphatic hydrocarbyl-substituted amines, hydrocarbyl-substituted poly(oxyalkylene) amines, hydrocarbyl-substituted succinimides, Mannich reaction products, nitro and amino aromatic esters of polyalkylphenoxyalkanols, polyalkylphenoxyaminoalkanes, and mixtures thereof.

13. The method of Claim 1, wherein the nitrogen-containing detergent additives in the cleaning, composition have a concentration in a range from about 1 to about 10 wt. %, based on a total weight of the cleaning composition.

14. The Method of claim 1, Wherein the compression ignition engine is a direct injection compression ignition engine.

15. The method of Claim 1, wherein the compression ignition engine is an indirect injection compression ignition engine.

16. The method of claim 1, wherein the fuel injector deposits are a mixture of polymeric deposits and sodium compounds.

17. The method of claim 11, wherein the one or more aliphatic hydrocarbon solvents in the cleaning composition have a concentration of from about 10 to about 70 wt. %, based on a total weight of the cleaning composition.

18. The method of claim 11, wherein the one or more aliphatic hydrocarbon solvents in the cleaning composition have a concentration of from about 35 to about 60 wt. %, based on a total weight of the cleaning composition.

* * * * *